United States Patent [19]

Heusler et al.

[11] 4,179,020

[45] Dec. 18, 1979

[54] TRANSPORTER FOR THE TRANSPORTATION OF PIECES OF BAGGAGE INTEGRATED WITH AN ESCALATOR

[75] Inventors: Helmut Heusler, Dortmund; Fritz Behle, Hattingen, both of Fed. Rep. of Germany

[73] Assignee: O&K Orenstein & Koppel Aktiengesellschaft, Berlin, Fed. Rep. of Germany

[21] Appl. No.: 873,368

[22] Filed: Jan. 30, 1978

[30] Foreign Application Priority Data

Jan. 28, 1977 [DE] Fed. Rep. of Germany ..... 2703436

[51] Int. Cl.[2] ..... B66B 9/12

[52] U.S. Cl. ..... 198/326; 198/321

[58] Field of Search ..... 198/321, 326, 330, 331, 198/570

[56] References Cited

U.S. PATENT DOCUMENTS

| | | | |
|---|---|---|---|
| 3,049,213 | 8/1962 | Fabula | 198/331 |
| 3,096,725 | 7/1963 | Widmer | 198/321 |
| 3,151,726 | 10/1964 | Nelson | 198/321 |
| 3,414,108 | 12/1968 | Jackson et al. | 198/321 |
| 3,696,909 | 10/1972 | Kojima et al. | 198/331 |

FOREIGN PATENT DOCUMENTS

| | | | |
|---|---|---|---|
| 567135 | 10/1957 | Italy | 198/321 |

*Primary Examiner*—Jeffrey V. Nase

*Attorney, Agent, or Firm*—Martin A. Farber

[57] ABSTRACT

A transporter conveyor system, integrated with an escalator, for the transportation of pieces of baggage from one conveying plane to a different conveying plane. Parallel to the escalator for the transportation of people there is arranged an endless baggage conveyor belt which is provided with balustrades, which conveyor belt is driven synchronously with the escalator.

10 Claims, 8 Drawing Figures

Figures 1, 1A:
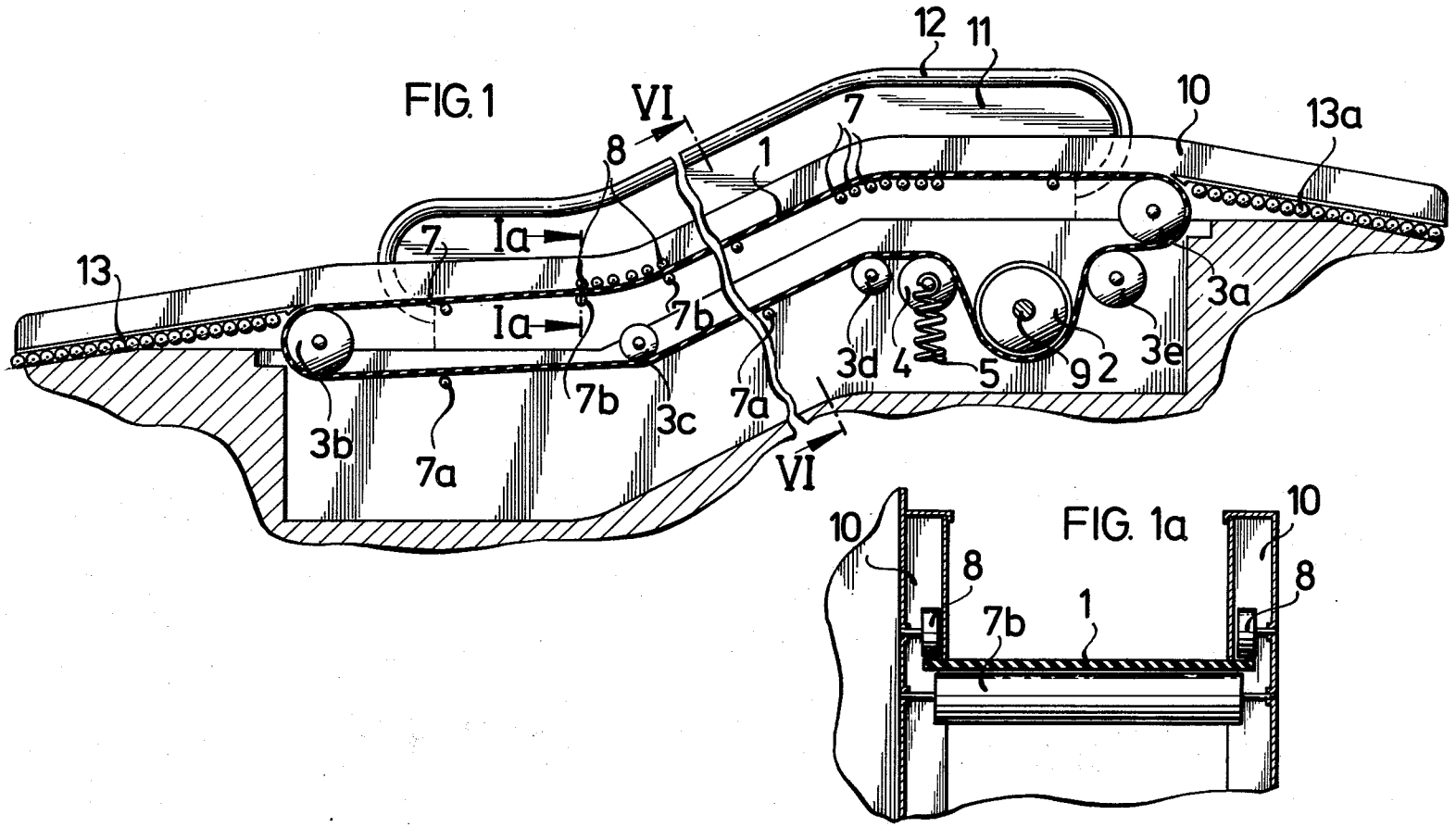

TRANSPORTER FOR THE TRANSPORTATION OF PIECES OF BAGGAGE INTEGRATED WITH AN ESCALATOR

The invention relates to a transporter or conveyor system, integrated with an escalator, for the transportation of pieces of baggage and the like from one conveying plane to a conveying plane different from the first.

If escalators-passers-by, e.g. flight passengers in an airport, take their suitcases along on an escalator, it is known to the passengers so as to make it easier to them to take baggage along, to place available or for disposition, hand trailers or carts to be carried along. Such type of transportation means are not safely or surely to be rested or set on the moving stairsteps because of the rise or grade of the steps so that the passers-by, which themselves must pay attention to the escalator, yet additionally are made unsure or disconcerted. Such transportation means which is not integrated with the escalator moreover obstructs the passage for rushing or urgent passers-by and hinders the view of the entrance of the escalator.

The invention is based on the task to provide an arrangement for carrying along of baggage which facilitates the passers-by using the escalator, to carry their baggage piece along with them comfortably and without risk to the next landing.

The solution of this task is brought about in accordance with the invention in the manner that parallel to the escalator which serves the transportation of people there is arranged an endless baggage conveyor belt provided with balustrades, the conveyor being synchronously driven with the escalator. In formation of the invention the shaft of the drive drum of the baggage conveyor belt and the main drive shaft for the steps of the escalator are flush in alignment, and both shafts are directly coupled with one another.

Further particulars of the invention follow from the additional claims and from the following description.

The advantage of the arrangement in accordance with the present invention resides in that the passers-by from the escalator simultaneously are able to take with them baggage pieces on a conveyor system or transporter, the latter which is separated from the escalator, and during the entrance and during the exiting of the escalator immediately have the suitcases available gripping at the handle, without being hindered by transportation means to be used itself by them.

Figure 2:
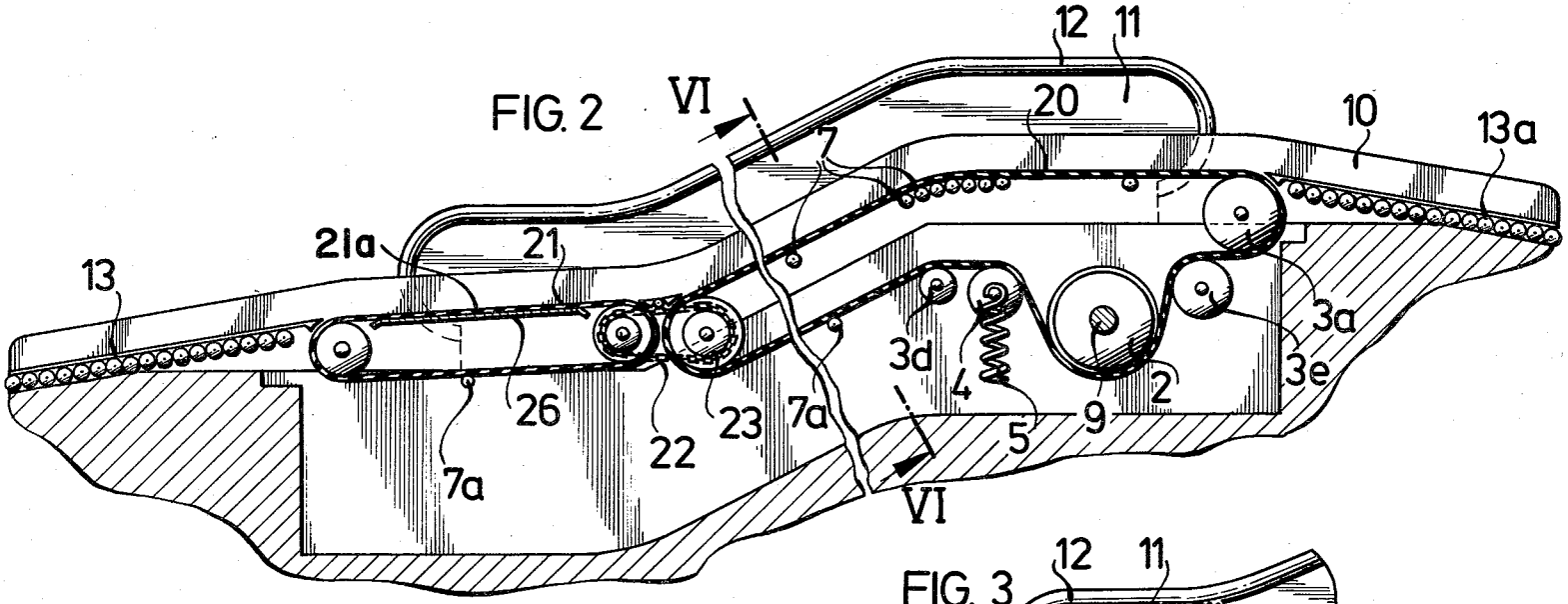
Figure 3:
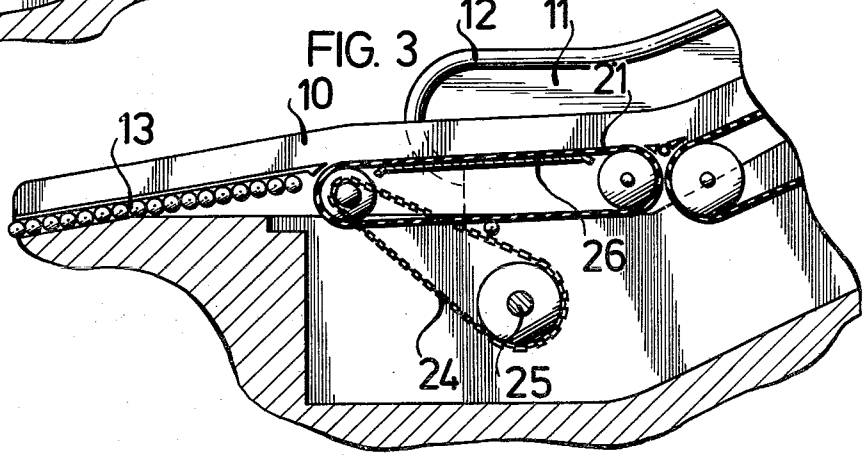
Figure 5:
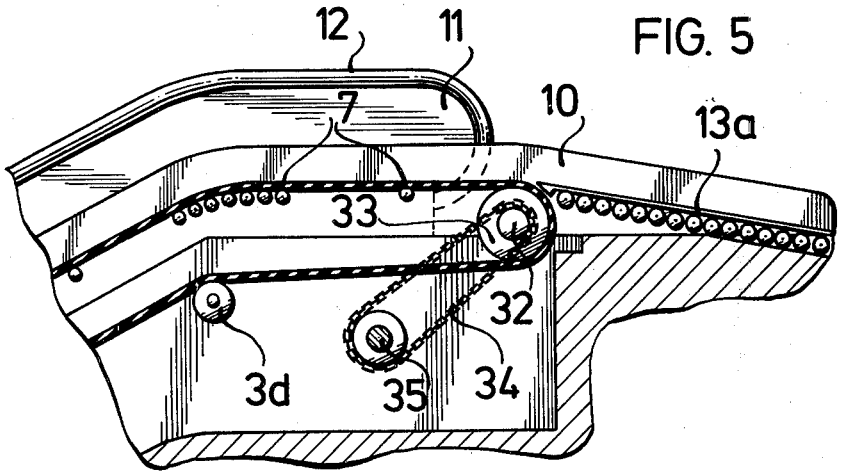
Figure 4:
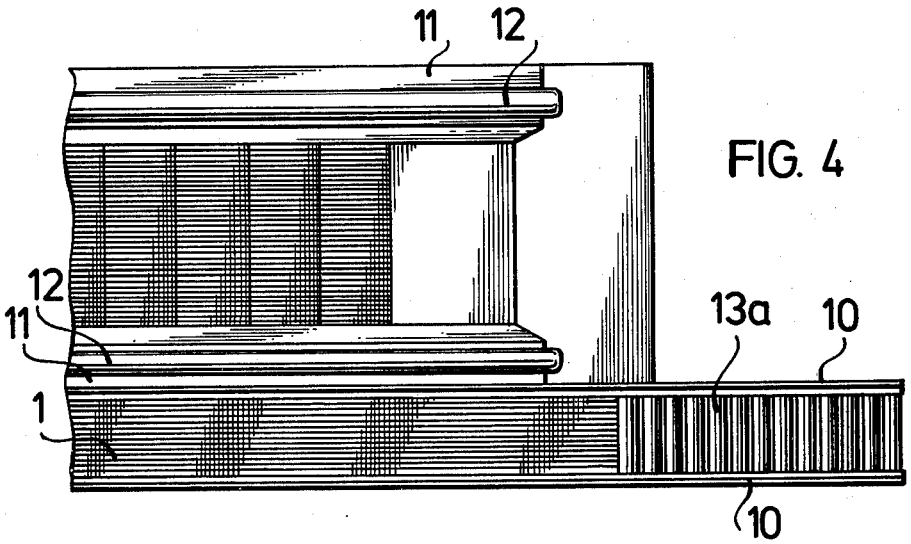
Figure 6:
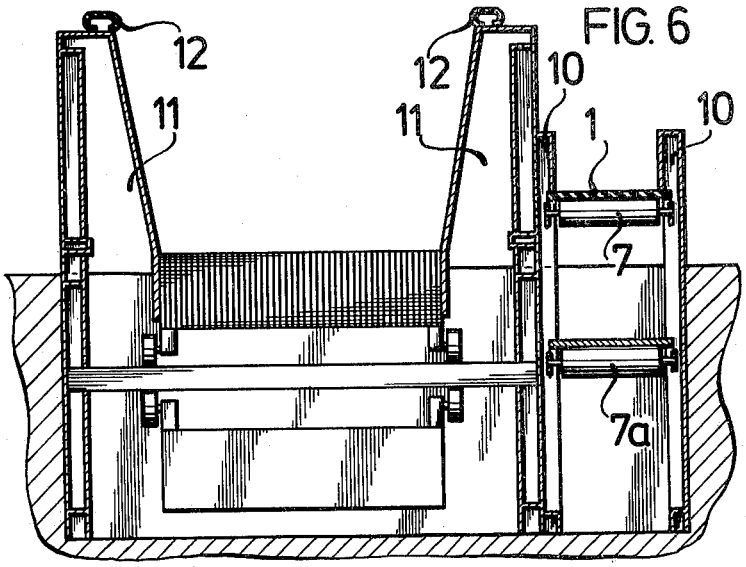
Figure 7:
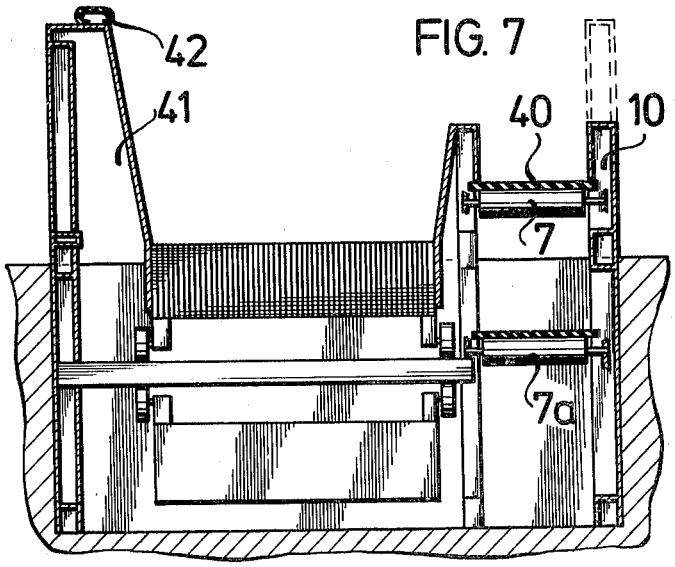

In the drawings two embodiment examples of the invention are illustrated. It shows:

FIG. 1—a longitudinal section through a baggage transporter with a continuous rubber conveyor and a side view of the essential parts of an escalator, FIG. 1*a*—a section y-y according to FIG. 1 with the arrangement of the support rollers which hold the conveyor belt on the track, FIG. 2—a longiudinal section through another embodiment of a baggage transporter with two rubber conveyor belts which are inclined relative to one another and a side view of the essential parts of an escalator, FIG. 3—a section through another embodiment of the drive of the arrangement according to FIG. 2, FIG. 4—a plan view on a part of the escalator with entrance and corresponding part of the baggage conveyor, FIG. 5—a section through the drive of the drive drum of the baggage conveyor belt by means of a chain, FIG. 6—a cross-section through an escalator and baggage transporter according to the lines x—x of FIG. 1, FIG. 7—a cross-section through an escalator provided with only one balustrade and a baggage transporter integrated with this.

An endless conveyor belt 1 made of rubber, which substantially has the length of the escalator, to which it is arranged in parallel, and is driven from the drive drum 2 and is guided over further drums 3*a*, 3*b*, 3*c*, 3*d* and 3*e*, whereby a tensioning drum 4 is provided with an adjustment or shifting device 5 for stretching or tensioning of the conveyor belt 1. The conveyor belt 1 is guided by means of support or carrying rotors 7, 7*a* and 7*b* parallel to the steps of the escalator; the carrier rollers 7*a* serve the return guidance of the conveyor belt 1. So that the conveyor belt 1 in the lower transition from the horizontal part to the inclined part of the escalator as a consequence of the pull exerted by the stretching or tensioning device 5 does not lift off from the carrier rollers 7*b*, support rollers 8 are arranged laterally in the balustrades 10 of the baggage transporter, the support rollers 8 acting from above. The drive of the drive drum 2 is brought about by the main drive shaft of the escalator, in the manner that the shaft 9 of the drive drum 2 is coupled directly with the main drive shaft. Balustrades 10 are arranged on both sides of the baggage conveyor belt 1, by means of which balustrades the suitcases or other hand baggage or luggage are prevented from laterally falling down from the baggage conveyor belt 1. The balustrades 10 have a lower height than the balustrades 11, the hand rails 12 of the escalator running on the latter. In order that the suitcases, even when the passers-by do not grab them at the handle, arrive properly on the baggage conveyor 1 and do not tumble down at the end of the belt, rollerette tracks 13, 13*a* are provided, which at both ends directly follow or join on the conveyor belt 1 and form collection or reception stations.

With another embodiment of the baggage conveyor belt there are provided two rubber conveyor belts 20 and 21 directly adjoining on each other. The conveyor belt 20 is arranged in the upper, horizontal, inclined part of the escalator, whereas the conveyor belt 21 is located in the lower, horizontal part of the escalator. The angle under which the two conveyor belts 20 and 21 are arranged with respect to each other corresponds approximately to that between the lower horizontal part and the inclined part of the escalator. The drive of the conveyor belt 20 takes place as that described with the first embodiment, i.e. it is brought about directly from the main shaft of the escalator drive (FIG. 2), or by means of a chain from the main drive shaft 35 of the escalator (FIG. 5). The drive of the conveyor belt 21 takes place either by means of a chain drive 22 from the reversing or tail pulley 23 of the conveyor belt 20 (FIG. 2), or by means of a chain drive 24 from the rotating shaft 25 of the escalator (FIG. 3). As also with the first embodiment the conveyor belt 20 is guided by means of carrier rollers 7, 7*a* and 7*b*. A sliding floor or bottom 26 is arranged under the part 21*a* of the conveyor belt 21, the part 21*a* serving for carrying along of the baggage pieces. Small roller tracks 13 and 13*a* are arranged on the free ends of the conveyor belts 20 and 21 as with the first embodiment. With both of the previously mentioned embodiment forms according to FIGS. 1 and 2 the drive takes place by means of a chain 34 from the main shaft 35 of the escalator on the shaft 32 of the drive drum 33.

With a further embodiment of the invention the baggage conveyor belt 40 is arranged directly parallel to an escalator, which escalator is provided only on one side with a balustrade 41 and hand rail 42.

The invention is not limited to the illustrated embodiment examples. The baggage transporter can also be used with roller climbers or ascenders. The baggage transporter can also be made of three rubber conveyor belts following one another in succession or in tandem, whereby the third belt is arranged adjacent to the upper, horizontal part of the escalator.

We claim:

1. A conveyor system for the transportation of pieces of baggage and the like from one conveying plane to another conveying plane integrated with an escalator for the transportation of people, comprising an escalator, at least one endless baggage conveyor belt arranged parallel to the escalator, first balustrades cooperatively mounted at said baggage conveyor belt on both lateral sides thereof, means for driving said conveyor belt synchronously with the escalator, said baggage conveyor belt is integrated with the escalator, said escalator has two second balustrades of a height substantially larger than that of said first balustrades, one of the first balustrades is integrally mounted on one of said second balustrades.

2. The conveyor system, according to claim 1, wherein said means comprises drive drum means engaging said baggage conveyor belt for driving said baggage conveyor belt, said drive drum means includes a shaft.

3. The conveyor system, according to claim 1, further comprising carrier roller means having a length substantially equal to the width of said baggage conveyor belt, engaging the latter from below and forming a path extending parallel to the band of steps of the escalator, support roller means disposed in said first balustrades in a vicinity of a lower transfer curve of said baggage conveyor belt from a horizontal part to an inclined part of the escalator, said support roller means for holding said conveyor belt on said path and engaging the latter from above.

4. The conveyor system, integrated with an escalator, according to claim 1, wherein said at least one baggage conveyor belt comprises two endless conveyor belts oriented parallel to the escalator, said two endless conveyor belts are operatively connected one behind the other and are driven synchronously with the escalator via said driving means, said two conveyor belts are arranged relative to one another at an angle corresponding to an angle formed between a horizontal part and an inclined upper part of the escalator, said first balustrades are coordinated to each of said two conveyor belts and extend on lateral sides of the latter, respectively.

5. The conveyor according to claim 4, wherein said means comprises drive shaft means for driving one of said two conveyor belts, said one of said two conveyor belts is arranged at an upper inclined part of the escalator.

6. The conveyor system, according to claim 4, wherein said escalator has a main drive shaft, said means comprises a drive drum means for driving one of said conveyor belts, said drive drum means has a shaft, said one of said conveyor belts is arranged at an upper inclined part of the escalator, chain means for driving said shaft of said drive drum means, said chain means is operatively connected from said main drive shaft of the escalator.

7. The conveyor system, according to claim 4, wherein said conveyor belts define two starting ends, rollerette track means disposed on both said starting ends, said rollerette track means for acceptance of the baggage pieces transported by said baggage conveyor belts.

8. The conveyor system, according to claim 4, wherein one of said conveyor belts constitutes an inclined conveyor belt, another of said two conveyor belts constitutes a substantially horizontal conveyor belt, the latter is arranged at a lower part of the escalator, said driving means is for driving said inclined conveyor belt, a reversing pulley is operatively connected to said inclined conveyor belt at an end of the latter adjacent said horizontal conveyor belt, chain means operatively connected to said reversing pulley for operatively driving said substantially horizontal conveyor belt, a slide is mounted adjacent and under an upper horizontal portion of said horizontal conveyor belt.

9. The conveyor system, according to claim 4, wherein one of said two conveyor belts is arranged at a lower part of the escalator, said escalator has a lower reversing shaft, said means for driving said one of said two conveyor belts comprises a chain operatively connected from said reversing shaft of the escalator.

10. The conveyor system, according to claim 1, further including a plurality of guide drums including two reversing drums guidably mounted on said baggage conveyor belt, tensioning drum means engaging a lower portion of said baggage conveyor belt for tensioning the latter and including means for biasing said tensioning drum means.

* * * * *